US009533233B2

(12) United States Patent
Rucker et al.

(10) Patent No.: US 9,533,233 B2
(45) Date of Patent: Jan. 3, 2017

(54) GRAPPLING APPARATUS AND METHOD OF OPERATION

(75) Inventors: J. Austin Rucker, Redondo Beach, CA (US); C. Evangelos Kafantaris, Los Angeles, CA (US); Susie E. Buckman, Torrance, CA (US); Leo Shen, Shen Zhen (CN); Roy Hu, Guangzhou (CN); Josiah T. S. Li, Monterey Park, CA (US)

(73) Assignee: Mattel, Inc., El Segundo, CA (US)

( * ) Notice: Subject to any disclaimer, the term of this patent is extended or adjusted under 35 U.S.C. 154(b) by 836 days.

(21) Appl. No.: 13/468,423

(22) Filed: May 10, 2012

(65) Prior Publication Data

US 2013/0237123 A1 Sep. 12, 2013

Related U.S. Application Data

(60) Provisional application No. 61/609,874, filed on Mar. 12, 2012.

(51) Int. Cl.
*A63H 3/20* (2006.01)
*A63H 13/02* (2006.01)

(52) U.S. Cl.
CPC ..... *A63H 13/02* (2013.01)

(58) Field of Classification Search
CPC ..... A63H 3/20
USPC ..... 446/330
See application file for complete search history.

(56) References Cited

U.S. PATENT DOCUMENTS 1,364,881 A * 1/1921 Koch ..... 446/374
1,573,203 A 2/1926 Strohacker
1,601,447 A * 9/1926 Huck ..... 446/375
1,674,943 A * 6/1928 Berger ..... 446/353
2,350,248 A * 5/1944 Nowlin ..... 74/84 S
2,697,302 A * 12/1954 Solomon ..... 446/322
3,264,778 A * 8/1966 Ryan ..... 446/299
3,353,823 A 11/1967 Sobel
3,577,676 A 5/1971 Powell
3,688,435 A 9/1972 Sapkus et al.
3,826,039 A * 7/1974 Disko et al. ..... 446/271
3,848,357 A * 11/1974 Morrison ..... 273/440.1
3,870,067 A * 3/1975 Janiszewski ..... 137/242
3,874,112 A * 4/1975 Sapkus et al. ..... 446/333
3,911,613 A * 10/1975 Morrison et al. ..... 446/338
(Continued)

OTHER PUBLICATIONS

EP0124237A1 Mawdsley 1983.*

*Primary Examiner* — Michael Dennis
*Assistant Examiner* — Dolores Collins
(74) *Attorney, Agent, or Firm* — Sheppard, Mullin, Richter & Hampton LLP

(57) ABSTRACT

One or more methods, apparatuses, and/or systems are disclosed herein for selectively grasping one or more target objects. The apparatus includes a string and a winding mechanism. The winding mechanism is configured to selectively unwind and wind the string, wherein a first portion of the apparatus is configured to be separated from a second portion of the apparatus when the string is unwound and wherein the first and second portions are configured to be adjacent to one another when the string is wound. A plurality of members are pivotally mounted to the apparatus and operably coupled to the winding mechanism, wherein the plurality of members are configured to grasp an object responsive to actuation of a button that is located within an area defined by the plurality of members.

23 Claims, 11 Drawing Sheets

(56) References Cited

U.S. PATENT DOCUMENTS

| | | | | | |
|---|---|---|---|---|---|
| 4,032,295 | A | | 6/1977 | Meyer et al. | |
| 4,095,367 | A | * | 6/1978 | Ogawa | 446/73 |
| 4,114,309 | A | | 9/1978 | Gay | |
| 4,204,138 | A | * | 5/1980 | Koinuma et al. | 315/39.51 |
| 4,216,612 | A | | 8/1980 | Erickson et al. | |
| 4,244,138 | A | * | 1/1981 | Holahan et al. | 446/301 |
| 4,307,533 | A | * | 12/1981 | Sims et al. | 446/94 |
| 4,315,650 | A | | 2/1982 | Yoshida | |
| 4,457,098 | A | | 7/1984 | Tsuzuki | |
| 4,469,327 | A | | 9/1984 | Ulrich et al. | |
| 4,576,586 | A | | 3/1986 | Amici et al. | |
| 4,579,543 | A | * | 4/1986 | Renger et al. | 446/334 |
| 4,579,544 | A | | 4/1986 | Matsushiro | |
| 4,585,425 | A | * | 4/1986 | Amici et al. | 446/327 |
| 4,585,426 | A | | 4/1986 | Rasmussen et al. | |
| 4,639,234 | A | | 1/1987 | Atwood | |
| 4,669,997 | A | | 6/1987 | Kulesza et al. | |
| 4,684,128 | A | * | 8/1987 | Verstraeten | 273/448 |
| 4,689,033 | A | | 8/1987 | Droller et al. | |
| 4,710,146 | A | | 12/1987 | Rasmussen et al. | |
| 4,718,667 | A | * | 1/1988 | Shoemaker, Jr. | 273/448 |
| 4,738,649 | A | * | 4/1988 | Delli Bovi et al. | 446/336 |
| 4,778,433 | A | * | 10/1988 | McKay et al. | 446/304 |
| 4,863,164 | A | | 9/1989 | Mizunuma | |
| 5,271,628 | A | * | 12/1993 | Okada | 273/448 |
| 5,286,228 | A | | 2/1994 | Lee et al. | |
| 5,299,905 | A | | 4/1994 | Rademacher | |
| 5,397,134 | A | * | 3/1995 | Fishman et al. | 463/25 |
| 5,415,417 | A | * | 5/1995 | Reis, Jr. | 273/447 |
| 5,478,269 | A | * | 12/1995 | Wolfram | 446/330 |
| 5,549,372 | A | * | 8/1996 | Lewis | 312/114 |
| 5,626,506 | A | * | 5/1997 | Halford et al. | 446/465 |
| 5,964,638 | A | * | 10/1999 | Emerson | 446/339 |
| 6,017,262 | A | | 1/2000 | Starnes | |
| 6,170,069 | B1 | * | 1/2001 | Ohtani et al. | 714/704 |
| 6,234,487 | B1 | * | 5/2001 | Shoemaker, Jr. | 273/447 |
| 6,273,781 | B1 | * | 8/2001 | Yamasaki | 446/330 |
| 6,443,793 | B1 | | 9/2002 | Huebl et al. | |
| 6,475,058 | B2 | | 11/2002 | Mammano et al. | |
| 6,502,657 | B2 | | 1/2003 | Kerrebrock et al. | |
| 6,568,984 | B1 | * | 5/2003 | Applewhite | 446/176 |
| 7,040,951 | B2 | | 5/2006 | Hornsby et al. | |
| 7,387,558 | B2 | | 6/2008 | Swisher et al. | |
| 7,537,506 | B2 | | 5/2009 | de la Torre | |
| 7,637,507 | B2 | * | 12/2009 | Peck et al. | 273/448 |
| 7,841,599 | B2 | * | 11/2010 | Todokoro | 273/447 |
| 8,382,551 | B2 | * | 2/2013 | Hong | 446/376 |
| 2011/0086572 | A1 | * | 4/2011 | De La Torre | A63H 3/20 446/330 |
| 2011/0130070 | A1 | * | 6/2011 | Hong | 446/330 |
| 2011/0177750 | A1 | * | 7/2011 | Ujita et al. | 446/263 |
| 2012/0142247 | A1 | * | 6/2012 | Hara et al. | 446/72 |
| 2013/0134670 | A1 | * | 5/2013 | Lam | 273/108.51 |

* cited by examiner

GRAPPLING APPARATUS AND METHOD OF OPERATION

CROSS REFERENCE TO RELATED APPLICATION

This application is a non-provisional patent application which claims the benefit of U.S. Provisional patent application 61/609,874 filed Mar. 12, 2012 the entire contents of which are incorporated herein by reference.

BACKGROUND

Product manufacturers frequently seek to entertain users. For example, a manufacturer may seek to produce a toy that is interactive in nature. Interactive toys tend to capture a user's interest for a longer period of time relative to non-interactive toys, thereby alleviating a problem or issue of the user quickly becoming disinterested with the toy.

Manufacturers attempt to include as many features (e.g., interactive features) in a product as possible in order to maximize the number of output feature combinations or conditions associated with the product's use. However, maximizing the number of output feature combinations tends to increase the complexity of the product in terms of its use, as well as the cost to fabricate the product. This problem is particularly pronounced in the context of toy products, where a child's parent/guardian may be reluctant to spend very much on the toy, and where the child may quickly become disinterested in a toy if the toy does not include many output features, or if it is too difficult to cause the output features to occur on the toy.

BRIEF SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

According to one aspect of the invention, a toy apparatus for grasping an object is provided. The toy apparatus includes a plurality of members movable between an open position and a closed position, the plurality of members defining a holding area. An actuator is disposed in the holding area, the actuator movable between a first position and a second position. A stored energy device is operably coupled to the plurality of members and the actuator, the stored energy device being configured to move the plurality of members to the closed position in response to the object contacting the actuator.

According to another aspect of the invention, a toy apparatus for grasping an object is provided. The toy apparatus includes a plurality of members movable between a closed position and an open position, the plurality of members defining a holding space. An actuator is disposed in the holding space. A first gear is operably coupled to the plurality of members, the first gear being rotatable to move the plurality of members from the open position to the closed position. A first mechanism is operably coupled to the actuator and operably coupled to rotate the first gear, the first mechanism being configured to rotate the first gear in response to the object contacting the actuator.

In accordance with yet another aspect of the invention, a toy apparatus for grasping an object is provided. The toy apparatus includes a first finger movable between a first position and a second position. A second finger is movable between a third position and a fourth position, the first finger and second finger cooperating to define a holding space. A first actuator is disposed within the holding space. A string is provided having a first end and a second end. A mechanism is operably coupled to the first actuator, the first finger and the second finger, the mechanism being coupled to the string, the mechanism being configured to move the first finger and second finger and to wind the string in response to the object contacting the first actuator.

Aspects of this disclosure may facilitate the manufacture, assembly, and use of a toy that may provide a user (e.g., a child) with hours of enjoyment while still being simple to use and being relatively inexpensive to fabricate or use.

These and other aspects of this disclosure will become more apparent upon a reading of the following detailed description and accompanying drawings.

BRIEF DESCRIPTION OF THE DRAWINGS

The present disclosure is illustrated by way of example and not limited in the accompanying figures in which like reference numerals and labels indicate similar elements.

DETAILED DESCRIPTION

Figure 2:
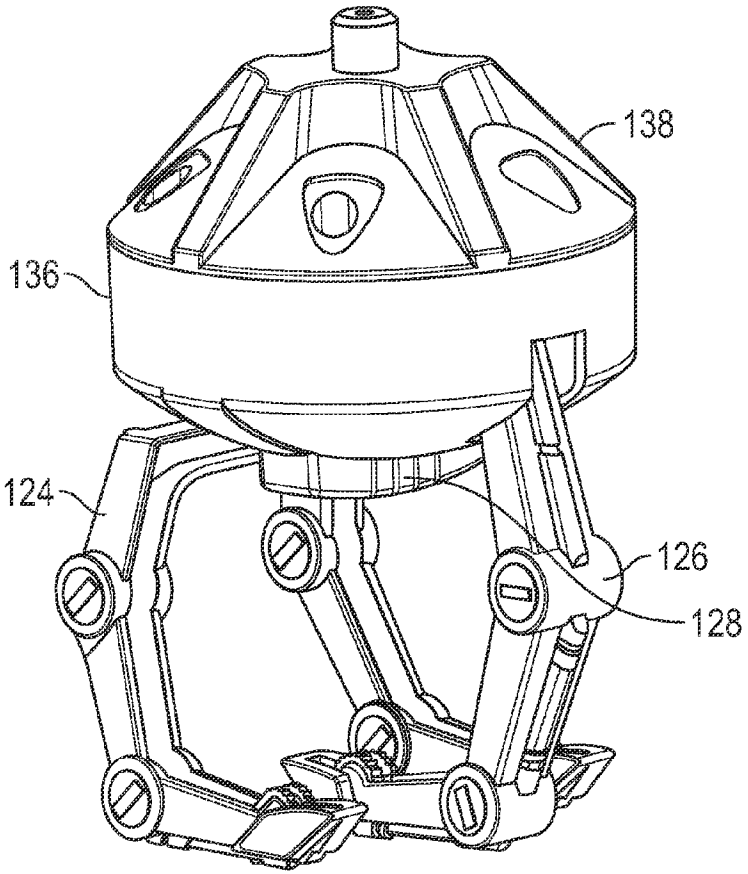
FIG. 2 is a perspective view illustrating a claw mechanism in accordance with one or more aspects of this disclosure.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect.

Figure 1:
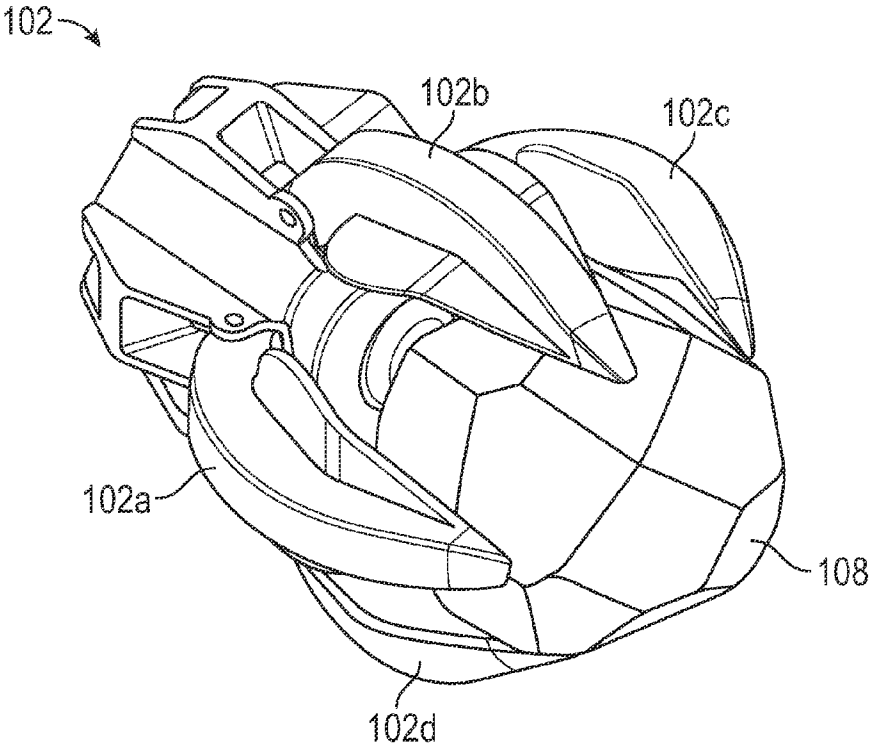
FIG. 1 is a perspective view illustrating a claw mechanism in accordance with one or more aspects of this disclosure.

FIG. 1 illustrates a claw mechanism in accordance with one or more aspects of this disclosure. In particular, in FIG. 1 a claw mechanism 102 is shown partially enclosing or grabbing an object 108 via four fingers 102*a* through 102*d*. The fingers 102*a*-102*d* define an area or space that includes the fingers 102*a*-102*d* and encloses the object 108. In some embodiments, more or fewer than four fingers may be associated with a claw mechanism. In FIG. 1, object 108 is largely spherical in terms of its shape. However, the claw mechanism 102 may be used to grasp objects of various shapes, sizes, and/or dimensions.

The size or length of fingers 102*a* through 102*d* may dictate the extent to which a given object 108 is enclosed by claw mechanism 102. For example, in some embodiments fingers 102*a* through 102*d* may be made longer so as to define a larger space that substantially encloses object 108. In other embodiments, a length and/or an angle of one or more of fingers 102*a* through 102*d* may be adjusted. For example, one of more of fingers 102*a* through 102*d* may be adjustable to accommodate grasping objects of various shapes, sizes, or dimensions. Further, the one or more fingers 102*a* through 102*d* may be configured to rotate, move linearly or have a range of motion combining rotary and linear movement.

Figure 3:
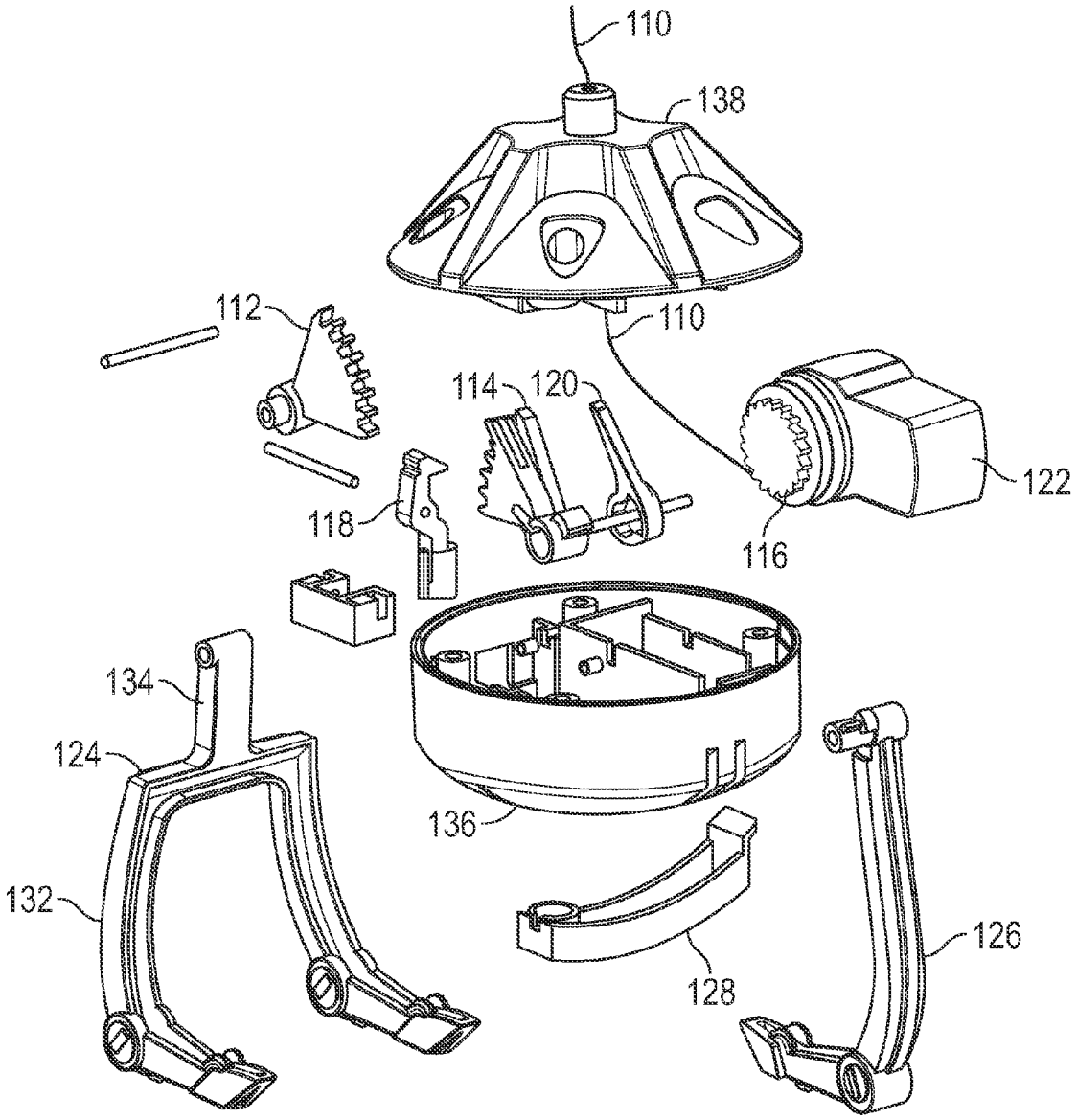
FIG. 3 is an exploded perspective view illustrating various parts of the claw mechanism of FIG. 2 in accordance with one or more aspects of this disclosure.

FIG. 3 illustrates various parts of a claw mechanism shown in an exploded view in accordance with one or more aspects of this disclosure. FIG. 2 illustrates the claw mechanism of FIG. 3 in assembled form. In some embodiments, claw mechanism 102 of FIG. 1 may include one or more of the parts shown in FIG. 3. It should be appreciated that the claws or fingers 102 may be formed in a number of configurations that cooperate to grasp or hold an object and the claimed invention should not be limited to the shapes described herein. In the embodiment of FIG. 1, the fingers 102*a*-102*d* are oriented such that the ends are pointed towards a center point. In the embodiment of FIGS. 2-3, the fingers 102*a*-102*d* have an "L" shape or a "dog-leg" shape which allows the ends of the fingers 102 to face each other in the closed position to substantially envelope an object.

As shown in FIG. 3, the parts of the claw mechanism may include one or more of a string 110, a first gear 112, a second gear 114, a third gear 116, a first lock block 118, a pawl or second lock block 120, a gear box 122, a finger 124, a thumb 126, and a button 128. A number of the parts may be included in, or enclosed by, a housing composed of one or more pieces, such as a first housing piece 136 and a second housing piece 138. Two or more housing pieces (e.g., pieces 136 and 138) may "snap" together. The various parts shown in FIG. 3 may be made of any number of materials. For example, plastics, synthetics, metals, etc., may be used in some embodiments. The various parts of the claw mechanism illustrated in FIG. 3 may be used to selectively grasp an object as described herein.

In the embodiment shown in FIG. 3, the string 110 is coupled to the gear box 122. The gear box 122 is a stored energy device having a member such as a spring or other elastic member that is configured to bias the fingers 124, 126 towards the closed position. The fingers 124, 126 define a space or holding area that may be used to grasp the object. This holding area is inclusive of the fingers 124, 126 themselves. As will be discussed in more detail below, energy may be stored in the gear box 122 by either pulling the string 110, or by manually extending the fingers 124, 126. The gear box 122 includes third gear 116 which is arranged to couple with the first gear 112 and second gear 114. The gears 112 and 114 are connected to the finger 124 and thumb 126, respectively, and transfer the rotary motion of the gear box 122 into linear and/or angular movement of the finger 124 and thumb 126. In one embodiment, the linear and/or angular movement of the finger 124 and thumb 126 is directly caused by the movement of the actuator or button 128 rather than with the gear box 122. In the exemplary embodiment, the finger 124 is comprised of a pair of arms 130, 132 connected to a single lever 134. The thumb 126 has a single arm. The arms of the thumb 126 and finger 124 may have a number of shapes, including but not limited to straight, curved, an "L" shape or a "dog-leg" shape.

Figure 4A:
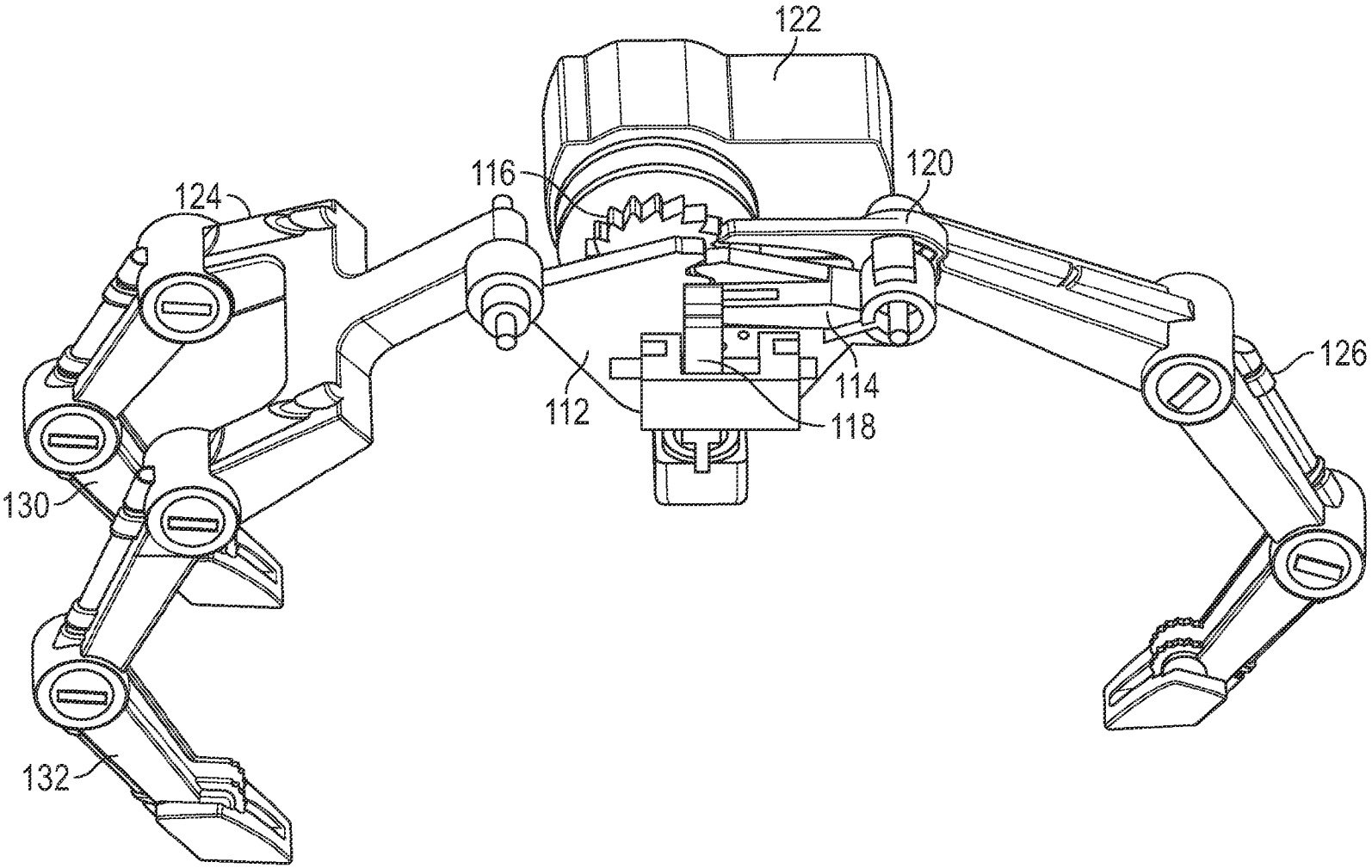
FIGS. 4A-4E are perspective views illustrating claw mechanisms in accordance with one or more aspects of this disclosure.
Figure 4B:
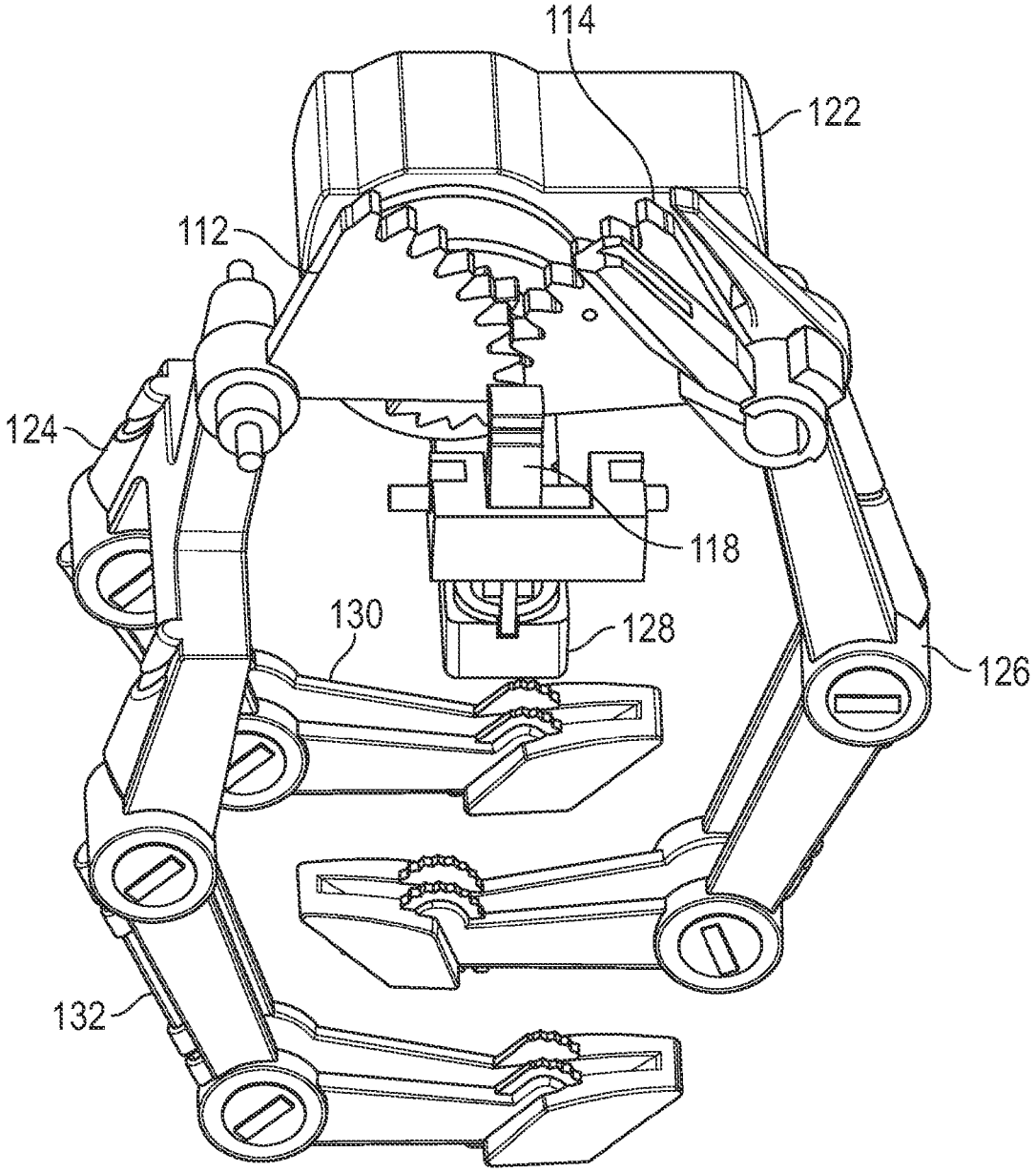
Figure 4C:
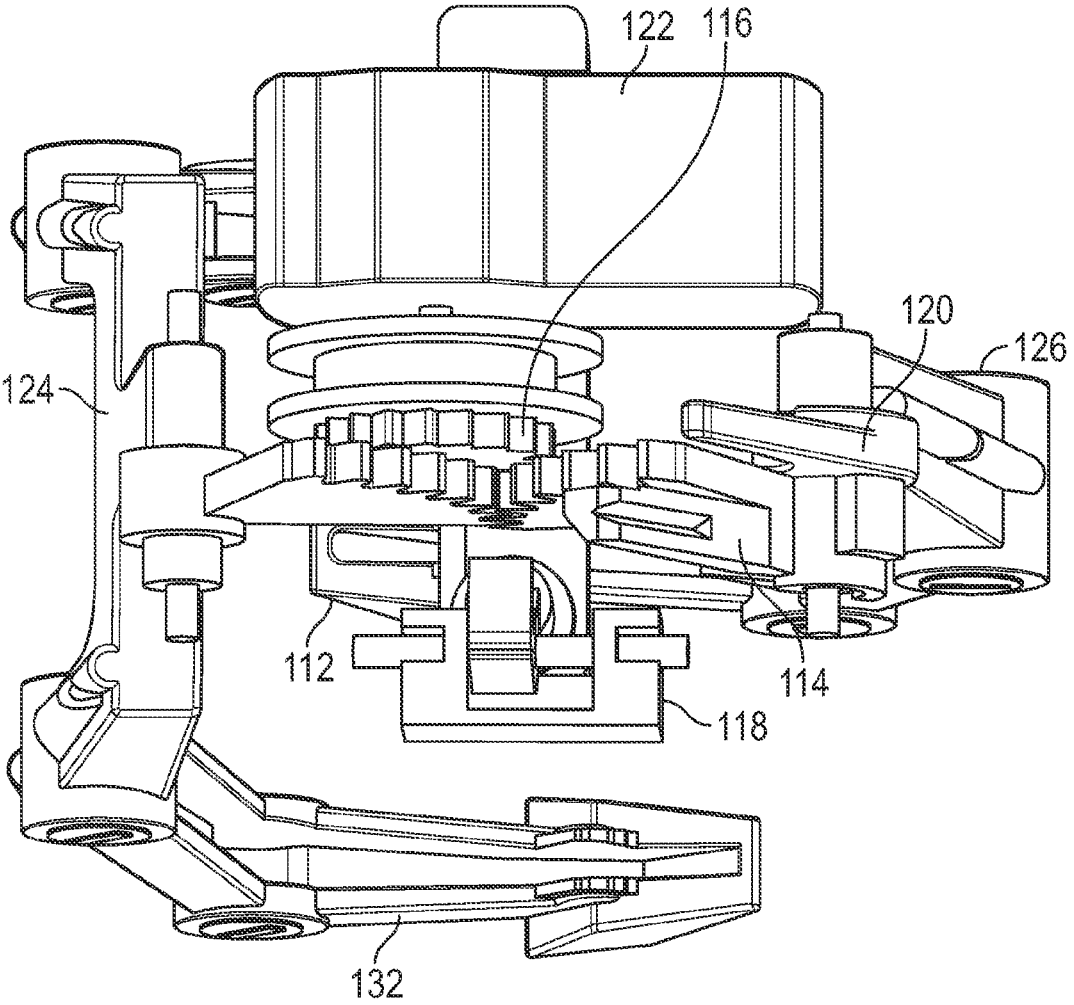
Figure 4D:
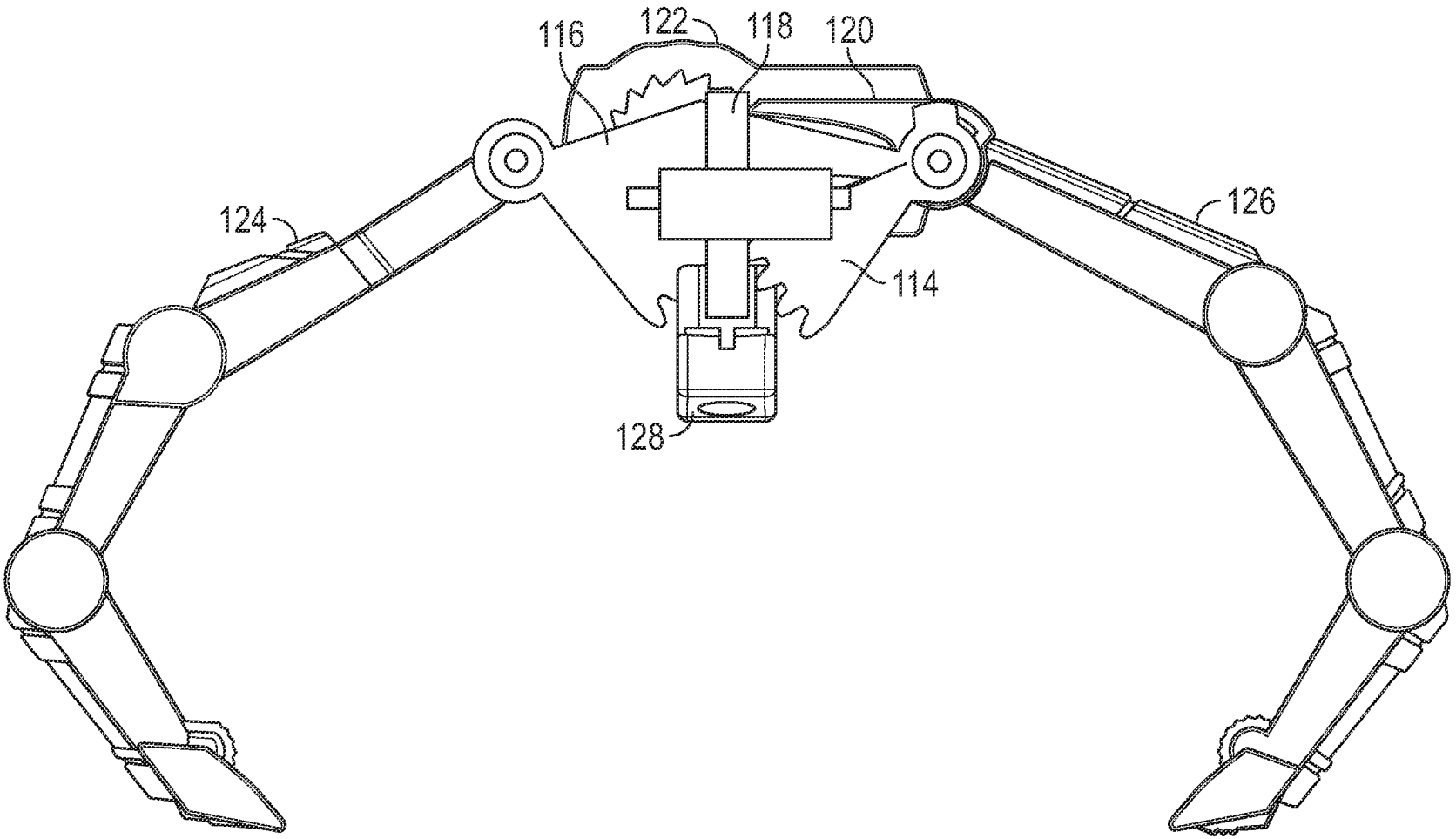
Figure 4E:
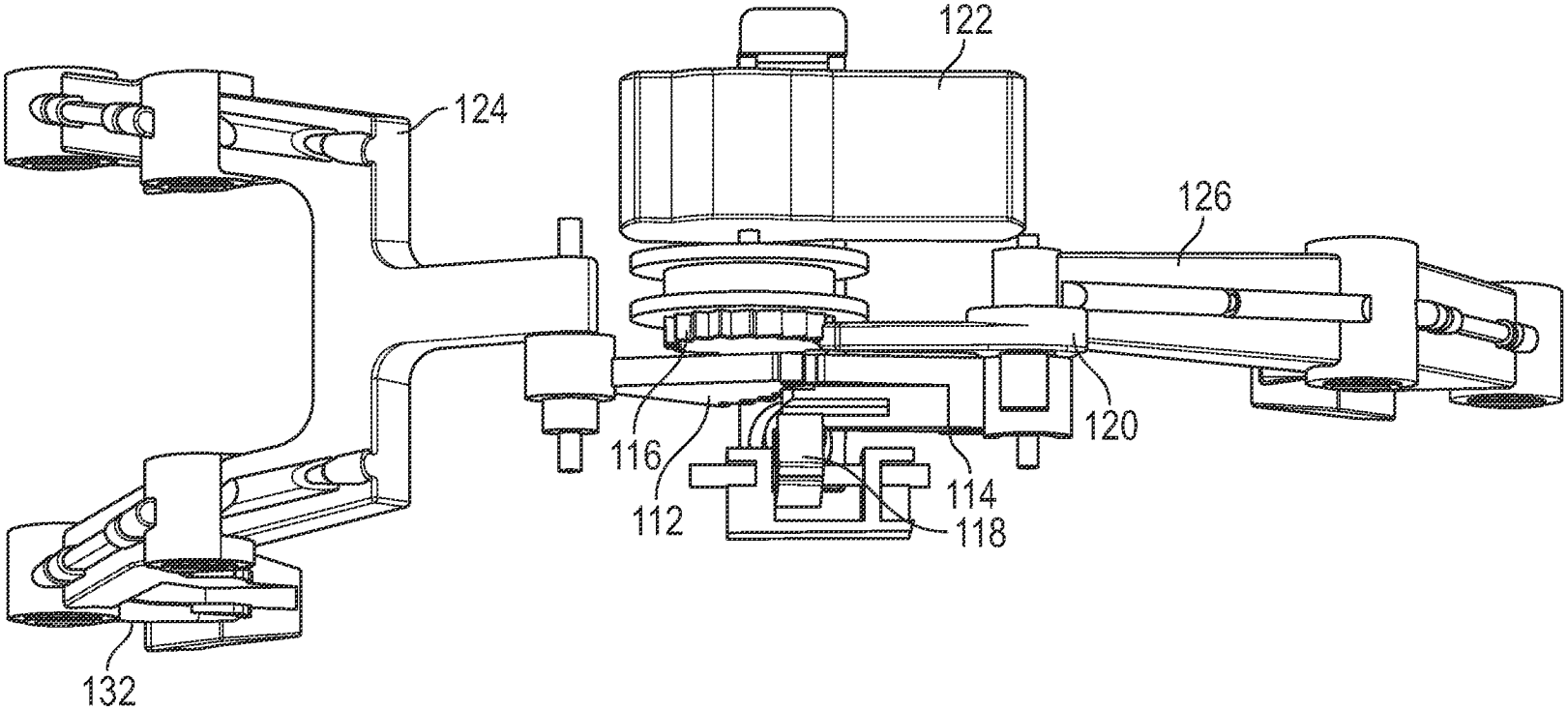
Figure 5:
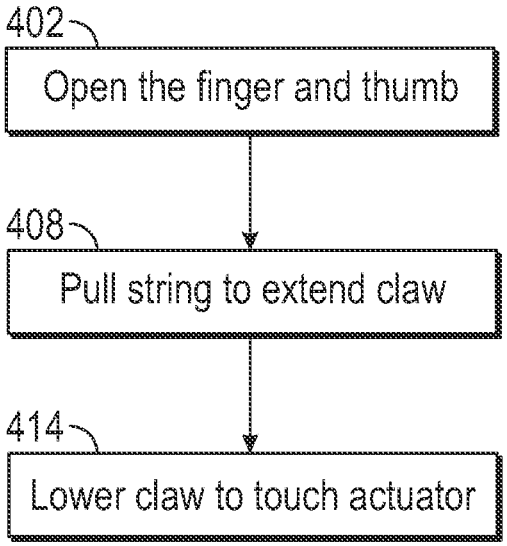
FIG. 5 illustrates a flow chart in accordance with one or more aspects of this disclosure.

FIG. 5 illustrates a flow chart in accordance with one or more aspects of this disclosure. In particular, the method illustrated in FIG. 5 may be used to grasp an object using one or more of the claw mechanisms described herein. For ease of illustration, the steps of the method of FIG. 5 are described below in connection with FIGS. 1, 2, 4A, and 4B. The method of FIG. 5 could be adapted to accommodate other claw mechanism configurations.

In step 402, the finger 124 and thumb 126 of the claw mechanism 102 may be opened or separated from one another. In some embodiments, a user may manually open or separate the finger 124 and the thumb 126 of the claw mechanism by directly applying a physical force to pull the finger 124 and thumb 126 apart from one another. The claw mechanism 102 may include an actuator (e.g., a button or switch—not shown) that may serve to separate a finger 124 and thumb 126 of the claw mechanism 102. In some embodiments, the actuator that serves to separate the finger 124 and thumb 126 may correspond to the button 128. The actuator/button 128 may be centrally disposed within the holding area defined by the finger 124 and thumb 126 as shown. in FIG. 2 and FIG. 3. In another embodiment, the actuator/button 128 may be incorporated into the finger 124 or thumb 126 such that when the object touches the finger 124 or thumb 126, the claw mechanism closes to grasp the object. In some embodiments, the actuator that serves to separate the finger 124 and thumb 126 of the claw mechanism may be different from the button shown in FIGS. 2 and 3 (not shown). FIG. 4A illustrates the finger 124 and thumb 126 of the claw mechanism in a separated or open position. In response to an input or stimulus that serves to open the claw mechanism, lock block 118 may hold gear 112 and gear 114, and lock block 120 may hold gear 116 in a fixed position.

In step 408, the claw mechanism 102 may be moved to an extended position that unwinds the string. For example, pulling on the exposed or external end of the string 110 may serve to unwind at least a portion of the string 110 that may have been wrapped around a portion of the gear box 122 when in a retracted or wound position. In some embodiments, the external end of the string 110 may include a handle, a loop (e.g., a plastic ring to allow for insertion of a user's finger), or other mechanism (not shown) to allow a user to easily hold the string 110 or to extend the claw mechanism 102. Where the claw mechanism 102 is integrated into a toy figurine 140 (FIGS. 6-7), the pulling or extension of the string 110 may further be accomplished by the user holding the toy figurine 140 and pulling the claw mechanism 102. In this regard, when the string 110 is unwound, a first portion of the claw mechanism 102 (e.g., the handle, loop, etc.) at a first end of the string 110 may be separated from a second portion of the claw mechanism 102 generally encompassing the rest of the claw mechanism 102 to which the string is attached on the gear box 122. Similarly, when the string 110 is wound, the first and second portions may be adjacent to one another or come into contact with one another. In response to the input or stimulus that serves to extend the claw mechanism, lock block 118 and lock block 120 may (continue to) lock gear 112 and gear 114, respectively.

In still other embodiments, the string 110 may be omitted and the claw mechanism 102 may be manually moved to the extended position by the user. This may provide advantages in allowing for a compact mechanism attached to the arm of the toy figurine, such as the one shown in FIG. 7. This may further provide advantages in allowing the claw mechanism 102 to be formed in the shape of a hand to simulate the grasping motion of fingers.

In step 414, an actuator 128 (e.g., the button shown in FIGS. 2 and 3) may be triggered when the actuator 128 comes in contact with a target object (e.g., object 108 of FIG. 1) to be grasped. The touching of the actuator 128 to the target object may cause lock block 118 to release gear 112 and gear 114, which may (automatically) cause the finger 124 and thumb 126 of the claw mechanism to at least partially envelope, enclose or grab the target object 108. In some embodiments, the touching of the actuator 128 to the target object 108 may also cause lock block 120 to release gear 116, which may (automatically) cause the string 110 to retract, thereby causing the claw mechanism to retract in a direction towards the user. FIG. 4B illustrates the finger 124 and thumb 126 of the claw mechanism 102 in a closed position (target object not shown in FIG. 4B).

In some embodiments, a claw mechanism 102 may be secured to, attached to, integrated with, or be made part of another entity 140. For example, as shown in FIGS. 6A-6D, a claw mechanism 102 may be secured to, attached to, integrated with, or be made part of a toy figurine 140. In this regard, a user may extend the operation of claw mechanism 102 in accordance with the user's imagination. For example, the user of claw mechanism 102 and/or toy figurine 140 may imagine taking part in one or more activities, such as a fight or a combat, and may use the claw mechanism 102 to capture one or more objects (e.g., weapons) belonging to an imaginary enemy. It should be appreciated that the claw mechanism 102 may be integrated into the toy figurine 140 in other configurations and the claimed invention should not be limited to the embodiments disclosed herein. For example, in the embodiment of FIG. 6, the winding mechanism 148 is integrated into the arm portion of the toy figurine 140, while in the embodiment of FIG. 7, the winding mechanism 148 may be integrated into the end portion 159. This provides advantages in allowing the claw mechanism 102 to be positioned separate from the arm and enhance user play.

Figure 6A:
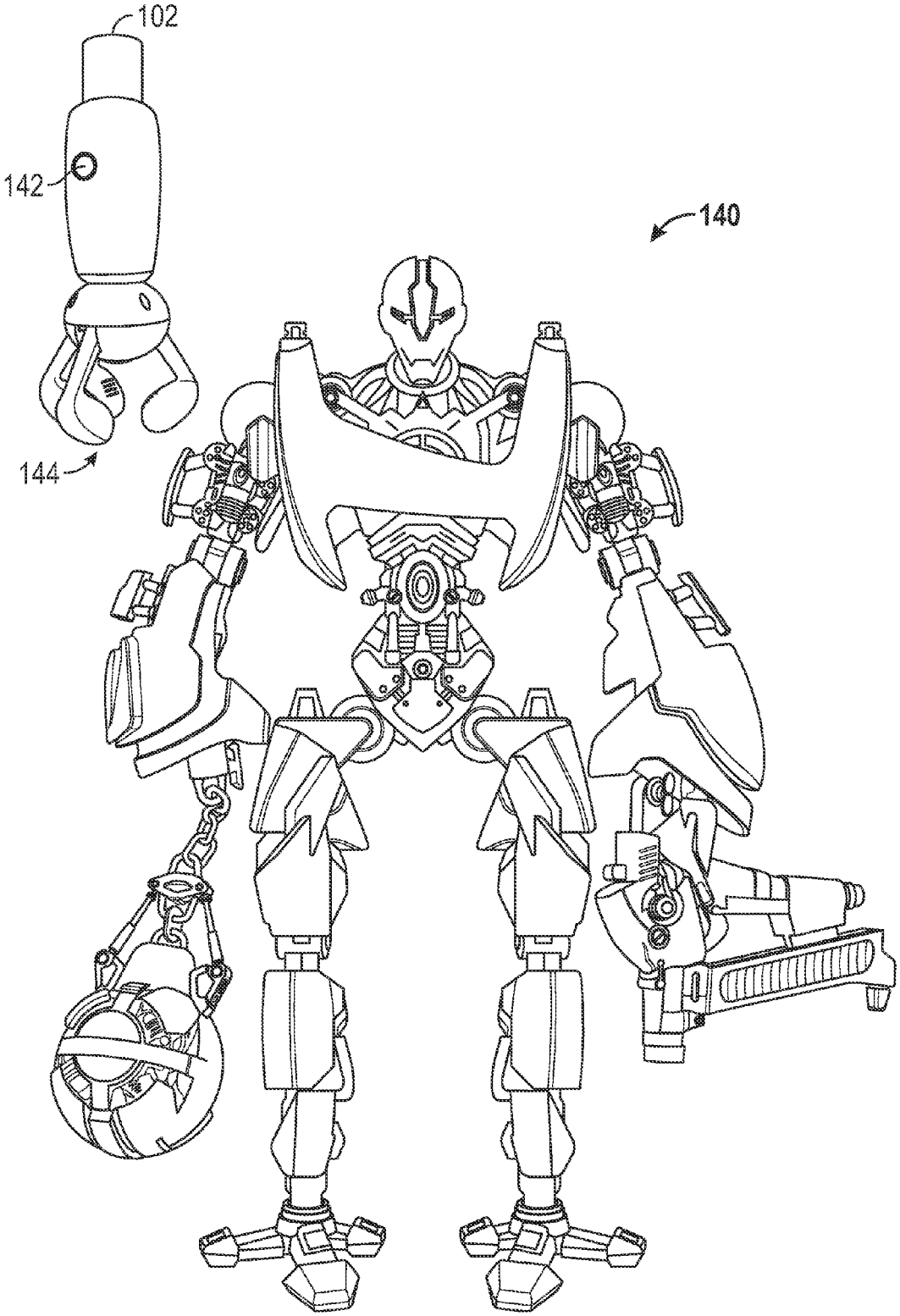
FIGS. 6A-6D are views of a claw mechanism included as part of a larger entity in accordance with one or more aspects of this disclosure.
Figure 6B:
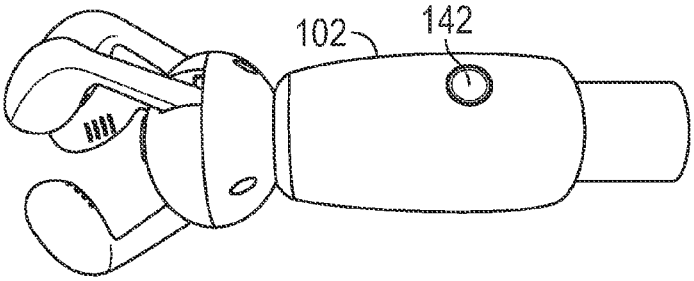
Figure 6C:
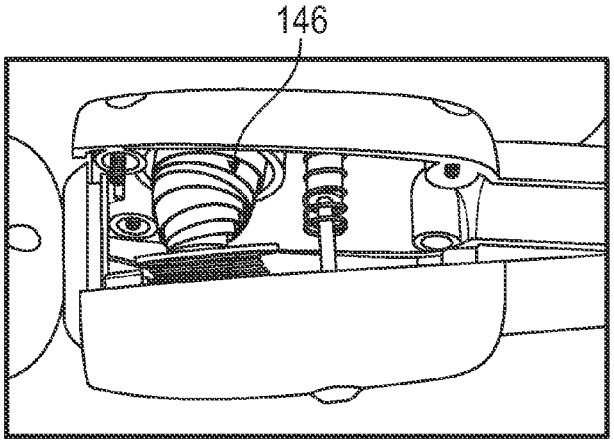
Figure 6D:
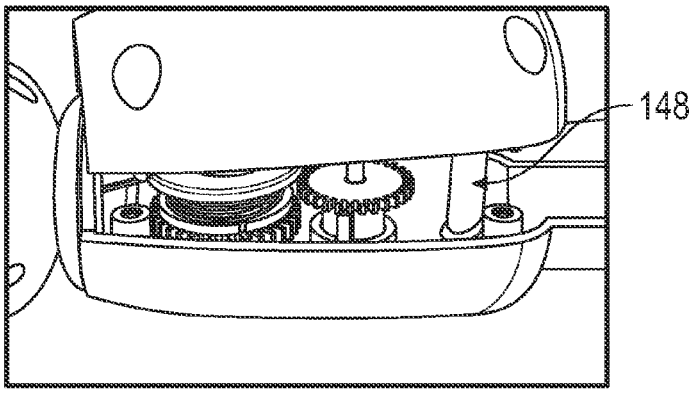

As shown in FIG. 6B, claw mechanism 102 is approximately sixteen (16) centimeters in length, which is approximately half the length of toy 140. Other lengths or sizes of claw mechanism 102 and/or toy figurine 140 may be used in some embodiments.

Claw mechanism 102 is shown as including a button 142. Button 142 may be used to perform one or more of: (1) selectively opening the fingers 144 of claw mechanism 102, (2) selectively closing the fingers 144 of claw mechanism 102, (3) selectively extending or unwinding a string associated with claw mechanism 102, and (4) selectively retracting or winding a string associated with claw mechanism 102.

In some embodiments, an entity 140 (e.g., a toy) is described having a claw mechanism 102 secured thereto. The claw mechanism 102 may be releasably attached to the toy and may have a cable or string fixedly secured to the toy 140 at one end and secured to a winding mechanism 146 located within the claw mechanism 102 at another end. The claw mechanism 102 may be configured to allow the cable to unwind therefrom such that the claw mechanism 102 is capable of being located at a location remote from the toy. Potential energy may be stored in the winding mechanism 148. The winding mechanism 148 may be configured to prevent the cable from being wound by the winding mechanism 148 unless an actuation button 142 or switch disposed on a surface of the claw mechanism 102 is depressed. The actuation button 142 may be located within an area defined by a plurality of claw members 144 pivotally mounted to the claw mechanism 102 such that when an object is grasped by the claw members 144 the actuation button 142 is depressed and the winding mechanism 148 is free to retract the cable such that the claw mechanism is pulled back towards the toy 140.

Figure 7:
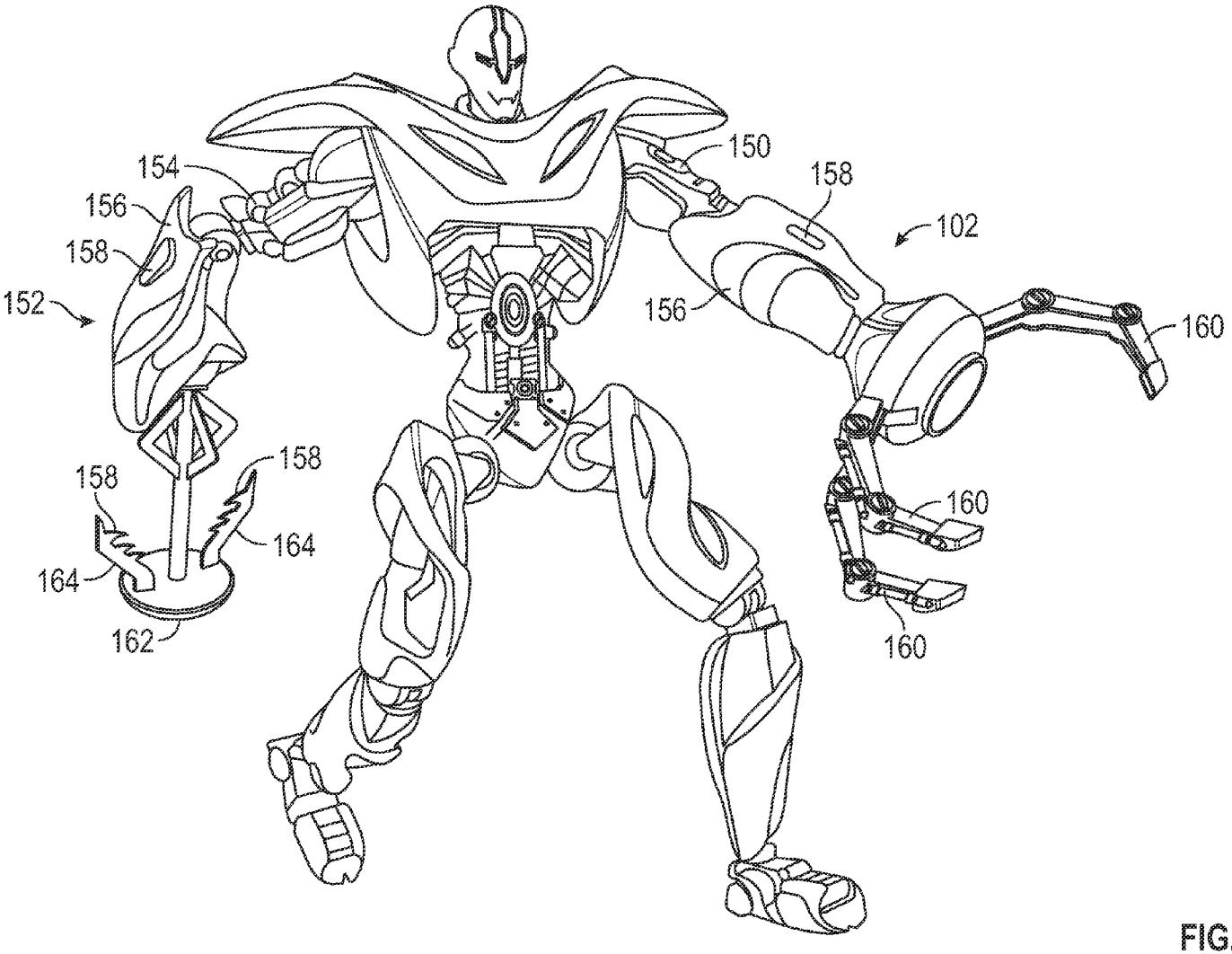
FIG. 7 is a view of another claw mechanism included as part of a larger entity in accordance with one or more aspects of this disclosure.

Referring now to FIG. 7, another embodiment of an entity 140 having a claw mechanism 102 coupled to a simulated appendage, such as a first arm 150 for example. The entity 140 may further include a second grappling mechanism 152 coupled to another appendage, such as second arm 154. Both the claw mechanism 102 and the grappling mechanism 152 include a body portion 156 that includes a button 158 that selectively activates a mechanism (e.g. winding mechanism 146) that extends or unwinds an associated string as described herein above. Both the claw mechanism 102 and grappling mechanism 152 may be configured to allow the string to unwind therefrom such that the mechanisms 102, 152 are capable of being located at a location remote from the toy. Potential energy may be stored in the winding mechanism. The winding mechanism may be configured to prevent the string from being wound by the winding mechanism unless the button 158 is depressed.

In this non-limiting embodiment, the claw mechanism 102 includes three fingers or arms 160 that extend from one end. The arms 160 are movable allowing the arms 160 to couple or grasp an object. The grappling mechanism includes an end 162, generally in the shape of a disk, having a pair of arms 164 that extend in the direction of the body 156. In one non-limiting embodiment, the arms 164 each have a plurality of projections or barbs 158 that may facilitate the coupling of the end 162 to an object.

In some embodiments, an entity, such as a toy, may comprise a first or stowed configuration wherein the reconfigurable toy resembles a flying craft. The toy may comprise a second or deployed configuration wherein a plurality of portions movably secured to the reconfigurable toy are reoriented to provide the second or deployed configuration wherein a plurality of features are accessible. In some embodiments, the plurality of features may include one or more of an elevator, a trap door, and a zip line. In some embodiments, the toy may resemble a piggy bank. For example, the toy may resemble a piggy bank when it is in the first or stowed configuration.

Aspects of this disclosure may be embodied as one or more apparatuses, systems, and/or methods. In some embodiments, aspects of the disclosure may be implemented via mechanical components, electrical components or circuits, or the like. While aspects of the disclosure have been described with reference to exemplary embodiments, it will be understood by those skilled in the art that various changes may be made and equivalents may be substituted for elements thereof without departing from the scope of this disclosure. In addition, many modifications may be made to adapt a particular situation or material to the teachings of the disclosure without departing from the essential scope thereof. Therefore, it is intended that the disclosure not be limited to the specific embodiments described herein, but that the disclosure will include all embodiments falling within the scope of the disclosure.

What is claimed is:

1. A toy apparatus for grasping an object, the apparatus comprising:

a plurality of members movable between an open position and a closed position, the plurality of members defining a holding area; and an actuator disposed in the holding area, the actuator movable between a first position and a second position;

a stored energy device operably coupled to the plurality of members and the actuator, the stored energy device being configured to move the plurality of members to the closed position in response to the object contacting the actuator;

a toy figurine having at least one arm, the stored energy device being coupled to the at least one arm;

a gear coupled between the energy storage device and the plurality of members; and a lock block coupled to the actuator and movable between an engaged position and a disengaged position, the lock block being movable to a disengaged position in response to the object contacting the actuator.

2. The toy apparatus of claim 1 further comprising a string;

a winding mechanism coupled to the string and operably coupled to the stored energy device, the winding mechanism being rotatable between a wound and an unwound position, the winding mechanism being configured to wind the string in response to the object contacting the actuator.

3. The toy apparatus of claim 2 wherein the plurality of members move from the closed position to the open position in response to the string being pulled.

4. The toy apparatus of claim 1 wherein the actuator is centrally disposed within the holding area.

5. The toy apparatus of claim 1 wherein the plurality of members includes:

a first finger defining a first portion of a periphery of the holding area, the first finger being disposed on the end of the at least one arm;

a second finger defining a second portion of the periphery of the holding area, the second finger being disposed on the end of the at least one arm; and wherein the actuator is centrally disposed on a surface arranged on one side of the holding area.

6. A toy apparatus for grasping an object comprising:

a plurality of members movable between an open and a closed position, the plurality of members defining a holding area;

an actuator disposed in the holding area;

a first gear operably coupled to the plurality of members, the first gear being rotatable to move the plurality of members from the open position to the closed position;

a first mechanism operably coupled to the actuator and operably coupled to rotate the first gear, the first mechanism being configured to rotate the first gear in response to the object contacting the actuator.

7. The toy apparatus of claim 6 wherein the plurality of members include a first member and a second member, the first gear being coupled to the first member.

8. The toy apparatus of claim 7 further comprising:

a second gear coupled to the second member and engaged with the first gear;

a third gear coupled to the first mechanism; and at least one lock block coupled between the actuator and the third gear.

9. The toy apparatus of claim 8 wherein the at least one lock block includes a first lock block coupled between the actuator and the first gear and a second lock block disposed between the first gear and the third gear, the second lock block being movable from an engaged position to a disengaged position in response to the object contacting the actuator.

10. The toy apparatus of claim 6 further comprising a string having a first end and a second end, the first end being coupled to the first mechanism.

11. The toy apparatus of claim 10 wherein the first mechanism is configured to wind the string in response to the object contacting the actuator.

12. The toy apparatus of claim 10 wherein the actuator is centrally disposed within the holding area.

13. The toy apparatus of claim 11 further comprising a figurine having at least one arm coupled to the string second end, the first mechanism being movable to a position distal from the arm when the string is unwound.

14. The toy apparatus of claim 12 further comprising:

a second mechanism coupled to the string second end, the second mechanism configured to selectively wind the string; and, a figurine having at least one arm coupled to the second mechanism, the first mechanism being movable to a position distal from the arm when the string is unwound.

15. The toy apparatus of claim 6, wherein the actuator is movable between a first position and a second position.

16. The toy apparatus of claim 15, wherein when the object contacts the actuator, the actuator moves from the first position to the second position.

17. The toy apparatus of claim 16, wherein in the second position, the actuator is depressed.

18. A toy apparatus for grasping an object, the toy apparatus comprising:

a first finger movable between a first position and a second position;

a second finger movable between a third position and a fourth position, the first finger and the second finger cooperating to define a holding area;

a first actuator disposed within the holding area;

a string having a first end and a second end;

a mechanism operably coupled to the first actuator, the first finger and the second finger, the mechanism being coupled to the string, the mechanism being configured to move the first finger and second finger and to wind the string in response to the object contacting the actuator.

19. The toy apparatus of claim 18 further comprising a figurine, the mechanism being coupled to the figurine.

20. The toy apparatus of claim 18 wherein the mechanism includes a first mechanism and a second mechanism, the first mechanism being coupled to the first end of the string, the second mechanism being operably coupled to the first finger and second finger and further being operably coupled to the string second end.

21. The toy apparatus of claim 20 wherein the first mechanism is coupled to the figurine and the second mechanism is movable to a position distal from the figurine when the string is unwound.

22. The toy mechanism of claim 21 wherein the first mechanism includes a second actuator, the first mechanism being configured to wind the string in response to an actuation of the second actuator.

23. The toy apparatus of claim 18, wherein the actuator is movable to a depressed configuration when the object contacts the actuator.

* * * * *